United States Patent [19]

Namanny et al.

[11] Patent Number: 5,067,716

[45] Date of Patent: Nov. 26, 1991

[54] PORTABLE MINIATURE GOLF SYSTEM AND METHOD OF USE

[76] Inventors: Kerry T. Namanny; Keith E. Namanny, both of 183 N. Main, Cumberland, Iowa 50843

[21] Appl. No.: 556,356

[22] Filed: Jul. 20, 1990

[51] Int. Cl.[5] ..... A63B 67/02

[52] U.S. Cl. ..... 273/176 R; 273/176 FB; 52/69

[58] Field of Search ..... 273/176 R, 176 F, 176 H, 273/176 FB; 52/71, 69

[56] References Cited

U.S. PATENT DOCUMENTS

| | | | |
|---|---|---|---|
| 1,582,183 | 4/1926 | Maurer | 273/176 H |
| 2,860,383 | 11/1958 | Heisler | 52/71 |
| 3,399,922 | 9/1968 | Burton | 52/69 |
| 3,604,710 | 9/1971 | Jacobs | 273/176 E |
| 3,727,917 | 4/1973 | MacLean | 273/176 H |
| 3,861,524 | 1/1975 | Coleman | 273/176 FB |
| 3,889,432 | 6/1975 | Geihl | 52/69 |
| 3,936,055 | 2/1976 | Scott | 273/176 H |
| 3,990,573 | 11/1976 | Cross | 273/176 FB |
| 4,429,881 | 2/1984 | Barrett | 273/176 F |
| 4,596,391 | 6/1986 | Carolan, Jr. | 273/176 FB |
| 4,647,046 | 3/1987 | Hurt | 273/176 E |

FOREIGN PATENT DOCUMENTS

| | | |
|---|---|---|
| 2547742 | 6/1983 | France . |
| 2223255 | 5/1972 | Netherlands . |

*Primary Examiner*—Edward M. Coven
*Assistant Examiner*—Steven B. Wong
*Attorney, Agent, or Firm*—James D. Welch

[57] ABSTRACT

A miniature golf game combined with a device for transporting it is disclosed. The miniature golf game includes numerous miniature golf greens which attach to the device for transporting them by way of respective attachments. The respective attachments allow the miniature golf greens to be raised and lowered with respect to the transport device and to be rotated around their points of attachment to their respective attachments. A user can orient and secure the miniature golf greens such that they are raised and rotated so as to project upward, for transporting them, and can alternatively orient the miniature golf greens so that they are lowered and project horizontally when miniature golf is to be played thereon. The time to effect the change in orientation for nine miniature golf greens is approximately five minutes. The miniature golf greens can also be completely removed from their respective attachments. Other devices, such as other games or pop and snacks can also be transported by the transport device.

4 Claims, 2 Drawing Sheets

PORTABLE MINIATURE GOLF SYSTEM AND METHOD OF USE

The invention taught in this disclosure was subject of Disclosure Document No. 247300.

TECHNICAL AREA

This invention relates to miniature golf games and more particularly to a quick and easy to use combination system of one or more miniature golf greens which rotatably and releasably mount to a transport means, such as a trailer or truck. Said combination system makes the setting-up of a miniature golf game for use, and the packing-up of same for transport, quick and easy. As a result, the combination system is particularly beneficial to those who operate miniature golf games at many different locations.

BACKGROUND

The concept of fixed location miniature golf games is well known, as evidenced by the existence of commercial miniature golf ranges throughout the United States. As well, the concept of portable miniature putting golf games for use in the home or office, for instance, is known. A search of relevant prior Patents shows that inventors have also considered the topic. A U.S. Pat. No. 3,604,710 to Jacobs, for instance, teaches an indoor golf putting game having a series of elongated relatively narrow putting greens all laid out on a single horizontal surface. In a U.S. Pat. No. 4,647,046 to Hurt, a portable miniature golf game adapted for indoor/outdoor use, particularly by people who are wheel chair bound or who use prosthetic devices is taught. A number of modules are taught which can be combined to make various configurations. Another U.S. Pat. No. 4,429,881 to Barrett teaches a system which includes various moveable blocking members. Users can move the blocking members in the system to provide at least eighteen different configurations, thereby simulating an eighteen hole miniature golf course. Also, a French Patent to Tempereau, No. FR 2547-742A teaches a system of folding modules comprising two main branches hinged at the center. The Tempereau system is used to facilitate easy setting up of games such as miniature golf games.

The above summary shows that the concept of miniature golf games is known. As well, there are teachings which disclose modular construction and folding or collapsable construction, which features make the associated apparatus easier to transport.

However, what is not known or taught in any reference of which the inventors of the present invention are aware is a combination system of one or more miniature golf greens, a means for transport and an interconnecting attachment means which allows quick and easy set-up of miniature golf games for use by players, and pack-up for transportation. Such a combination as alluded to would be of benefit to those who, for instance, move from location to location often and at each location must set up their equipment for use by those who wish to play miniature golf. A need exists for a self contained combination system which comprises one or more miniature golf greens attached to a transport means by way of attachment means, thereby providing a combination system which makes it quick and easy to set-up for play, and pack-up for transport, a miniature golf game.

DISCLOSURE OF THE INVENTION

The need identified in the Background Section is met by the present invention. The present invention comprises a transport means, such as a trailer which can be towed by a car or truck, or a self driven vehicle, to which transport means are attached one or more miniature golf greens. The miniature golf greens, (note that while a single miniature golf green could be used, hereafter it will be assumed that multiple miniature golf greens are present), are attached to the transport means by way of an attachment means. The attachment mean allows the associated miniature golf greens to be rotated so as to extend vertically or horizontally, (or what is an equivalent statement, perpendicular or parallel to a level horizontal surface surrounding the transport means when said transport means is positioned on a level horizontal surface). In the vertical position the miniature golf greens are positioned for transport, and in the horizontal position they are positioned for use by players of miniature golf. The attachment means also allows for vertically raising and lowering the miniature golf greens and securing said position. During transport the miniature golf greens will be in a raised position and during use by players they will be lowered so that their undersides rest on the level horizontal surface surrounding the transport means. The attachment means also provides for complete removal of the miniature golf greens from the transport means via an attachment means capability, in the event that they are to be used at a location inaccessible to the transport means but near thereto, (e.g. inside a building, for instance).

To aid with understanding a typical usage sequence for the present invention is provided. Assume the present invention to be present and in use by miniature golf players at location 1, and that the present invention is to be moved to location 2 for use by other miniature golf players. The operator of the present invention will have only to raise each miniature golf green using the enabling capability of the attachment means, then rotate each miniature golf green to a vertical position, and secure same in said vertical position by use of securing means affixed to the transport means. The transport means can then be caused to move to location 2, at which location the operator will have only to release each miniature golf green from the securing means affixed to the transport means, rotate the miniature golf green to the horizontal position and lower same so that it sits on the level horizontal surface surrounding the transport unit. The simplicity and ease of use should be appreciated from the forgoing. Generally less than five minutes is required to completely set-up or pack-up the system when nine miniature golf greens are present.

It is additionally noted that the transport means can also be used to carry other apparatus, or can even be a concession stand from which pop and snacks can be sold to those playing miniature golf and to others near the transport unit. Alternatively, the transport means could even house another amusement game, such as a basketball throw.

The present invention is then found in the combination of one or more miniature golf greens with a transport means via an attachment means, which attachment means provides certain beneficial capabilities to an operator. The combination system greatly enhances the ability of an operator of the combination system to quickly and easily configure the system for transport, or for use by players of miniature golf. In particular, it normally takes less than five minutes to set-up, or pack-up the combination system when required. The convenience of use provided by the present combination system is, to the inventors knowledge, unknown commercially and is not taught in any prior teachings.

SUMMARY OF THE INVENTION

An observation of commercially available apparatus, and a search of prior patents in the area pertaining to miniature golf shows that the concept of miniature golf games is well known. Various teachings focus on the configuration of miniature golf greens to provide various challenges to players, construction to allow handicapped players to play the game, modular construction which allows various miniature golf green configurations to be developed, and collapsable construction which enables easier transport of the apparatus.

No teachings known to the inventors, however, discloses that miniature golf greens should be combined with a transport means by way of attachment means, which attachment means provide the capability to an operator to quickly and easily configure the system for either transport or for use by players of miniature golf.

It is therefore a primary purpose of the present invention to provide a combination system of one or more miniature golf greens and a transport means, which one or more miniature golf greens and transport means are attached to one another by way of attachment means which allow an operator to quickly and easily configure the combination system for either transport or for use by players of miniature golf.

It is another purpose of the present invention to provide an attachment means which allows an associated miniature golf green to be rotated to either a vertical or horizontal position with respect to a level horizontal surface surrounding the transport means when said transport means is positioned on a level horizontal surface, and which also allows an associated miniature golf green to be raised or lowered vertically.

It is yet another purpose of the present invention to provide an attachment means which allows an associated miniature golf greens to be removed from attachment to the transport means if desired.

It is still yet another purpose of the present invention to teach that the transport means can double in use as a means to transport other apparatus, including other amusement games, or can even constitute a concession stand from which pop and snacks can be sold to the miniature golf players, and to others.

DETAILED DESCRIPTION

Figure 1:
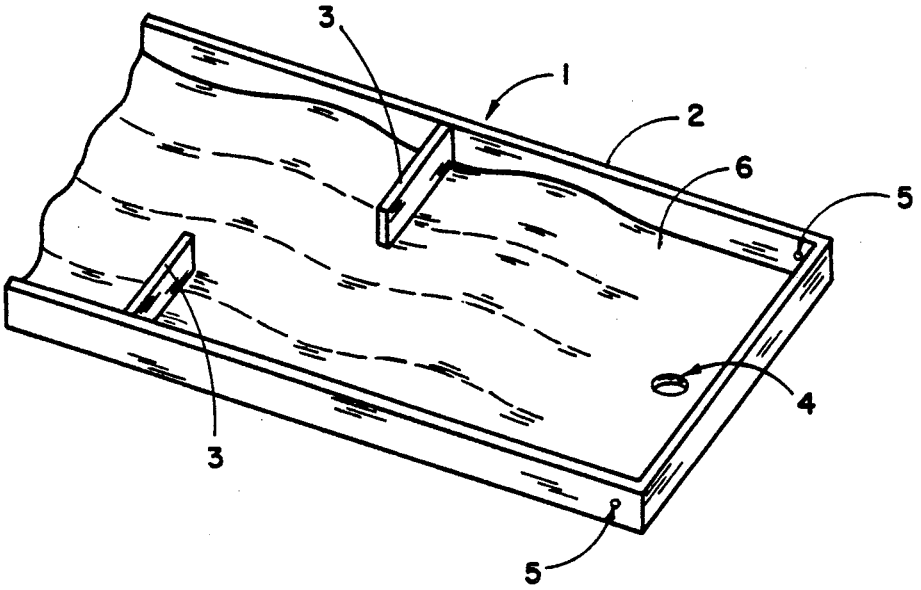
FIG. 1 demonstrates in perspective a partial view of a typical miniature golf green.

Turning now to FIG. 1, there is shown a partial general perspective view of an example miniature golf green (1) with sides (2) and playing surface (6). Indicated are example shot barriers (3) and a hole (4). Of importance to the present invention, there is also indicated a means (5) for mounting the miniature golf green (1) to a transport means via an attachment means. The mounting means (5) are exemplified as holes in the sides (2) of the miniature golf green (1), into which connecting pins or an equivalent can be placed.

Figure 2:
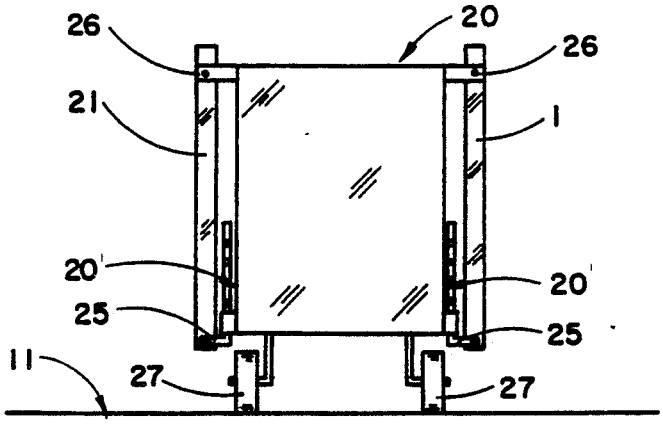
FIG. 2 shows an elevational view of the back of a typical transport means which has miniature golf greens attached to both sides thereof in a raised vertical orientation.

FIG. 2 shows a general elevational view from the back of a transport means (20) with miniature golf greens (1) and (21) vertically oriented and attached thereto at their lower extent by attachment means generally indicated as (25). Note that the attachment means (25) typically attach to the transport means (20) at the lower aspect of the transport means sides indicated as (20'). Miniature golf greens could attach to the front or back of the transport means (20) as well, and the attachment means could be located other than as specifically shown on the transport means (20). Note that the miniature greens (1) and (21) are given different designations to suggest that they are normally not simply duplicates of one another. The shot barriers and hole locations and possibly the shapes of different miniature golf greens will be positioned and laid out differently, for instance. Typically a transport means will have nine miniature golf greens attached thereto, (four on each side and one on the back), and each miniature golf green will have a different configuration of shot barriers and hole location on its playing surface (6). The difficulty a player will generally experience in sinking his or her golf ball on a miniature golf green will typically increase as he or she progresses from the first miniature golf green to the last miniature golf green encountered in a suggested sequence. It is also mentioned that the various miniature golf greens can be of differing widths, but will generally be no wider than 21 inches. The lengths of the miniature golf greens present will normally all be of one length, that being less than 12 feet, but any lengths which will not lead to problems in clearing underpasses when the miniature golf greens are oriented vertically during transport are possible. Also shown are transport means wheels (27). In this figure there are two pairs of wheels indicated, but it is also within the scope of the present invention to provide other than two pairs of wheels on the transport means. Additionally, there are shown generally securing means (26) for securing the miniature golf greens in a vertical orientation. Said securing means (26) can be a latch or any functional equivalent thereto.

Figure 3:
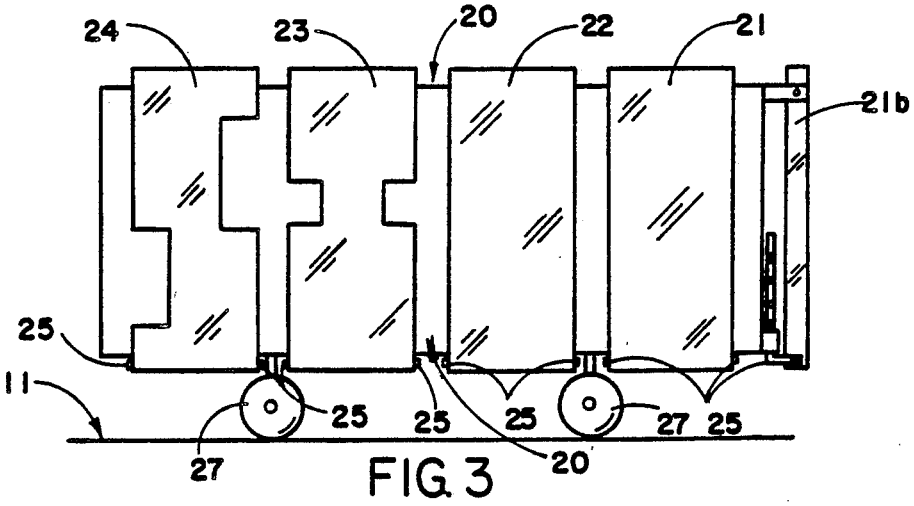
FIG. 3 shows an elevational view of the side of a typical transport means with four miniature golf greens attached to the side thereof and one miniature golf green attached to the back thereof, with all miniature golf greens in a raised vertical orientation.

FIG. 3 shows the transport means (20) in a side elevational view with four miniature golf greens (21), (22), (23) and (24) attached thereto ont the sides thereof and one miniature golf green (21*b*) attached to the back thereof. Attachment means are shown generally as (25). Also, note that in both FIGS. 2 and 3 the miniature golf greens are show in a position raised so that the lower end of the miniature golf greens as so viewed is above the level horizontal surface (11) surrounding the transport means (20). FIGS. 2 and 3 are presented primarily to show the miniature golf greens (1), (21), (22), (23) and (24) and transport means (20) combination as it will generally appear when configured for transport. That is, the various miniature golf greens are shown elevated and secured in a vertical orientation and firmly secured to the transport means (20), by securing means (26).

Figure 4:
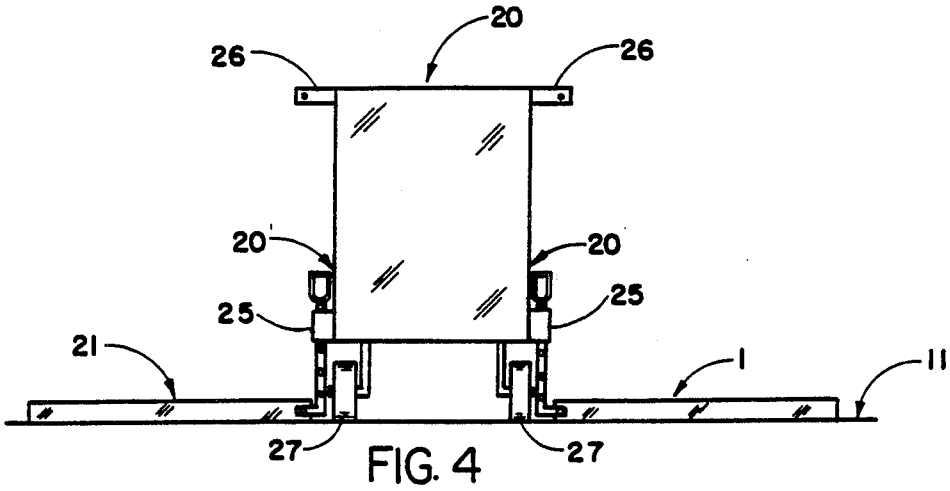
FIG. 4 shows an elevational view of the back of a typical transport means with miniature golf greens attached thereto in a lowered horizontal orientation.

FIG. 4 shows an elevational view of the miniature golf greens (1) and (21) and transport means (20) combination from the back of the transport means (20). The miniature golf greens (1) and (21) are shown oriented horizontally and lowered to rest on their undersides on the level horizontal surface (11) surrounding the transport means (20), in which orientation the miniature golf greens can be used by players of miniature golf.

Figure 5:
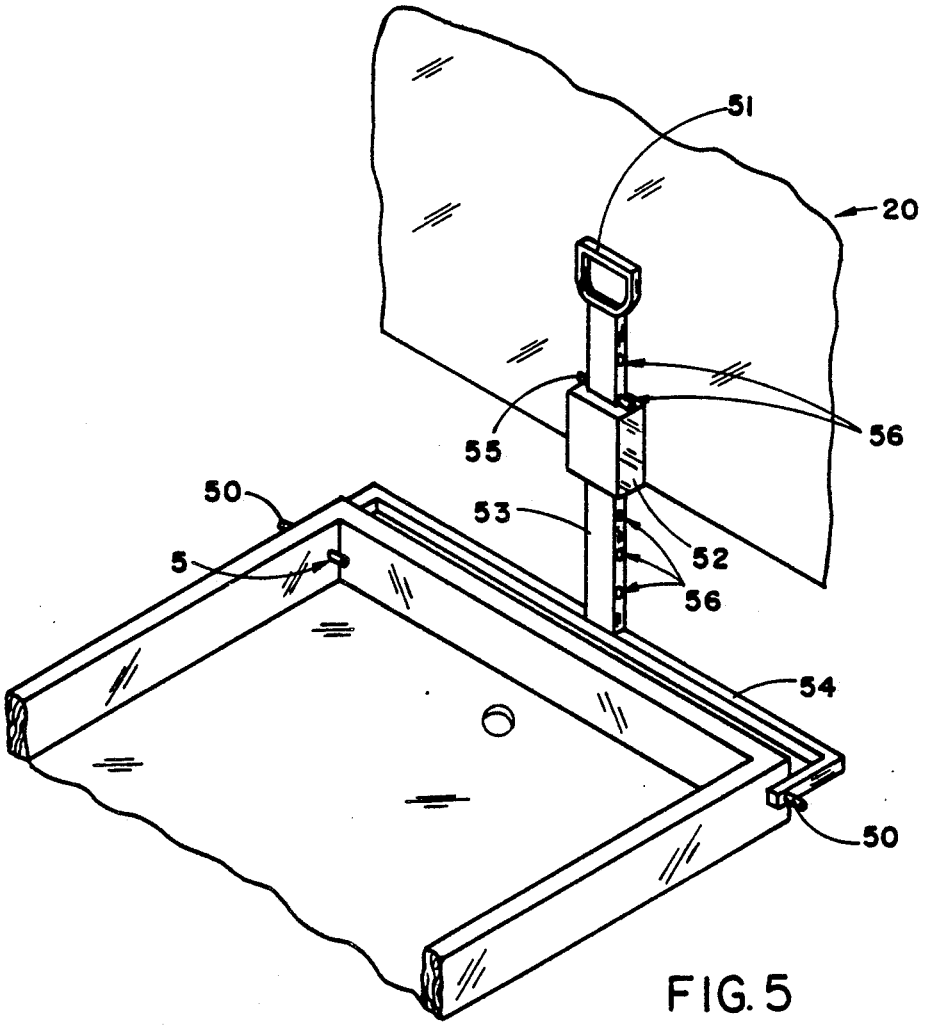
FIG. 5 shows a perspective view of the preferred embodiment of an attachment means between a partially shown miniature golf green and a partially shown transport means.

Turning now to FIG. 5, there is shown a perspective view of the preferred embodiment of the attachment means generally indicated here-to-fore as (25). The vertical side or front or back of transport means (20) in the vertically lower area labeled (20') is shown in breakaway fashion. Attached to the transport means (20) in the area labeled (20') is shown a mounting bracket (52). Said mounting bracket (52) is constructed so as to have a hole vertically extending therethrough. Sliding element (53), it is seen, is held within said vertically extending hole in mounting bracket (52). Sliding element (53) is also seen to have a handle (51) affixed to its upper extent, and a miniature golf green contacting bracket (54) attached to its lower extent. Sliding element (53) also has a multiplicity of small holes (56) therein, shown along its lateral side. FIG. 5 shows that a pin, or equivalent (55), is placed into one of the small holes (56) in sliding element (53) to secure it at some vertical position within mounting bracket (52). Also shown are pins, or equivalent (50) which extend into a the mounting means (5) in the miniature golf green shown. It is noted that while pins are shown, a rod might also be used which extends entirely through a miniature golf green into mounting holes in the miniature golf green contacting bracket (54) which have pins (50) shown as present therein in FIG. 5. In addition, there might also be included some form of locking device which serves to keep pins (50) and (55) in the positions shown. Such locking devices could be "C" rings or cotter pins or any functional equivalent, for instance. It is also disclosed that the locking devices at pins (50), or the functional equivalent of pins (50), can be removed so that the miniature golf green can be removed from the miniature golf green contacting bracket (54). If this is done the miniature golf green can then be independently moved to a location inaccessible to the transport means (20). Such might occur, for instance, where the game is to be played indoors.

It should be now appreciated that with the present combination invention, an operator of a miniature golf game can quickly and easily set-up the miniature golf greens for use by miniature golf players, or pack-up the miniature golf greens for transport. The actions required of an operator will typically take less than five minutes for each change, and the actions required by the operator will be simply the lifting or lowering of handle (51), and an equally simple rotation of a miniature golf green to a vertical orientation, (for transport), or to a horizontal position, (for use by players). If it is necessary to remove the miniature golf greens from the miniature golf green contacting bracket (54), more time will, of course, be required. However, in most usages, such removal of a miniature golf green will not be required.

It is also mentioned that while the terms "vertical" and "horizontal" have been used to describe the major orientations of miniature golf greens in the foregoing, said terms are meant to be understood to include "near vertical" and "near horizontal" as well. Also, when the terms vertical and horizontal are used with respect to a level horizontal surface surrounding a transport means, the terms "perpendicular to" and "parallel to" are to be considered equivalent, respectively.

Finally, it is also disclosed that the transport means (20) can be used to transport apparatus additional to the miniature golf greens and associated golf clubs and golf balls etc., and could even be a mobile concession stand from which pop and snacks could be sold. As well, an additional amusement game could also be transported within the interior of the transport means. It has been suggested that a basketball throw might fit nicely.

Having hereby disclosed the subject matter of this invention, it should be obvious that many modifications, substitutions and variations of the present invention are possible in light of the above teachings. It is therefore to be understood that the invention may be practiced other than as specifically described and should be limited in breadth and scope only by the claims.

We claim:

1. A combination system comprising a transport means with one or more miniature golf greens attached thereto by attachment means;

each of which miniature golf greens has a long and a short dimension and a playing and a lower surface;

each of which miniature golf greens is comprised of said playing and lower surfaces, as well as sides, shot barriers, a hole and mounting means, which sides and shot barriers project vertically above the level of the playing surface of a miniature golf green when it is viewed in side elevation from a distance perpendicularly removed from a side thereof when the lower surface of the miniature golf green is setting upon a level horizontal surface;

which sides essentially encompass the playing surface, and which shot barriers are placed at locations on the playing surface;

which hole is in the playing surface and projects downward from the playing surface when the miniature golf green is viewed in side elevation from a distance perpendicularly removed from a side, when the miniature golf green is oriented as described above;

which mounting means are located on the miniature golf green so as to allow attachment of the miniature golf green to the transport means by way of attachment means, which attachment means attach to said mounting means;

each of which miniature golf greens allows a player thereon to cause a golf ball to be rolled upon the playing surface thereof, within the confines of the sides, around short barriers and into the hole thereof when the lower surface of the miniature golf green is resting on a level horizontal surface;

which attachment means comprises:

a. a mounting bracket which has a hole vertically therethrough as the mounting means bracket is viewed in frontal elevation at a distance perpendicularly removed therefrom, which mounting bracket is permenantly affixed to the vertical surface of a side, the front and/or back of the transport means when said transport means is positioned on a level horizontal surface;

b. a sliding element which freely but securly slides vertically through the vertically oriented hole through the mounting bracket, which sliding element has a handle affixed to its upper aspect above the location of the mounting bracket, and which sliding element has a multiplicity of holes extending therethrough along its vertically oriented length, from one side to the other, as the sliding element is viewed in frontal elevation from a distance perpendicularly removed therefrom, and which sliding element has affixed thereto at its lower aspect below the location of the mounting bracket, a miniature golf green contacting bracket such that said miniature golf green contacting bracket is oriented so as to be simultaneously parallel to both the transport means to which the mounting bracket is attached at the point of its contact thereto and to the level horizontal surface surrounding the transport means, which miniature golf green contacting bracket also has projections therefrom which are oriented simultaneously both perpendicular to the transport means at the point the mounting bracket is attached thereto and parallel to the level horizontal surface surrounding the transport means, which projections from the miniature golf green contacting bracket have thereon means for attaching a miniature golf green, by way of the mounting means thereon, to said miniature golf green contacting bracket in a manner which allows the attached miniature golf green to be rotated between a parallel and a perpendicular orientation with respect to a level horizontal surface surrounding the transport means, and which sliding element can be caused to be raised and lowered as a result of force applied to the handle affixed to the upper aspect of the sliding element, and secured in a raised or lowered position by placing a pin or equivalent into one of the multiplicity of holes which extend from one side of the sliding element to the other side thereof, above the level of the upper aspect of the mounting bracket, so that the ends of the pin, or equivalent, project from the sides of the sliding element and rest on the upper surface of the mounting bracket, thereby, by functional interaction with the sliding element, retaining the sliding element in the intended position.

2. A combination system, as in claim 1, in which an attachment means allows its associated miniature golf green to be totally released therefrom at the mounting means thereon, said mounting means comprising holes present in oppositely oriented sides of the miniature golf green, which holes are accessed by the means incorporated into the attachment means, which means interact with said holes in a manner which allows release of the miniature golf green therefrom.

3. A method of transporting and using one or more miniature golf greens comprising the steps of:

a. attaching one or more miniature golf greens to a transport means by attachment means;

each of which miniature golf greens has a long and a short dimension and a playing and a lower surface, and each of which miniature golf greens further comprises, sides, shot barriers, a hole and mounting means, which playing surface, sides, shot barriers and hole are functionally combined to allow a player thereon to cause a golf ball to roll upon the playing surface within the confines of the sides, around shot barriers and into the hole thereof when the lower surface of the miniature golf green is resting upon a level horizontal surface;

which attachment between each of the one or more miniature golf greens and the transport means is by way of attachment between the attachment means and the mounting means of each of the miniature golf greens;

which attachment means allows each of the one or more miniature golf greens to be individually rotated so that the long dimension thereof is in a vertical, (perpendicular), or horizontal, (parallel), position, with respect to level horizontal surface surrounding the transport means when said transport means is positioned on a level horizontal surface, and which attachment means also allows the lower aspect of the one or more miniature golf greens to be independently vertically raised or lowered, with respect to a level horizontal surface surrounding the transport means, and secured with the lower aspect of the miniature golf green at some distance above the level horizontal surface;

b. causing the one or more miniature golf greens to be vertically raised and secured in said position by the attachment means, with the lower aspects of the one or more miniature golf greens at some distance above the level horizontal surface surrounding the transport means;

c. rotating the one or more miniature golf greens so that the long dimensions thereof are in a vertical position, essentially perpendicular to the level horizontal surface surrounding the transport means, and securing the one or more miniature golf greens in said position by way of securing means on the transport means;

d. causing the transport means to be moved from one location to another and positioned on another level horizontal surface;

e. rotating the one or more miniature golf greens so that their long dimensions are in a horizontal orientation, essentially parallel to the level horizontal surface surrounding the transport means, in the second location; and f. causing the one or more miniature golf greens to be lowered so that the lower surfaces thereof rest on the level horizontal surface surrounding the transport means in an orientation which allows players to play miniature golf thereon.

4. A method of transporting and using one or more miniature golf greens, as in claim 3 which further comprises the step of removing the miniature golf greens from their associated attachment means for use at a location removed from the transport unit.

* * * * *